US010747168B2

(12) United States Patent
Ohashi et al.

(10) Patent No.: US 10,747,168 B2
(45) Date of Patent: Aug. 18, 2020

(54) CONTROL APPARATUS FOR DRIVING A MEMBER INTO ROTATION AND IMAGE FORMING APPARATUS

(71) Applicant: CANON KABUSHIKI KAISHA, Tokyo (JP)

(72) Inventors: Eijiro Ohashi, Tokyo (JP); Masaru Tanaka, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/507,592

(22) Filed: Jul. 10, 2019

(65) Prior Publication Data

US 2020/0033788 A1 Jan. 30, 2020

(30) Foreign Application Priority Data

Jul. 25, 2018 (JP) ..... 2018-139622

(51) Int. Cl.
*G03G 21/16* (2006.01)
*G03G 15/08* (2006.01)

(52) U.S. Cl.
CPC ..... *G03G 21/1647* (2013.01); *G03G 15/0822* (2013.01); *G03G 21/1676* (2013.01)

(58) Field of Classification Search
CPC ..... G03G 15/0822; G03G 21/1647; G03G 21/1676
See application file for complete search history.

(56) References Cited

U.S. PATENT DOCUMENTS

2007/0075666 A1* 4/2007 Abe ..... G03G 15/5008 318/432
2010/0008689 A1* 1/2010 Iwasaki ..... G03G 15/167 399/66
2011/0293307 A1* 12/2011 Ogata ..... G03G 15/161 399/66
2018/0039221 A1* 2/2018 Nakamoto ..... G03G 15/1615
2018/0059593 A1* 3/2018 Ishiguro ..... G03G 15/55

FOREIGN PATENT DOCUMENTS

JP 07298678 A 11/1995
JP 2003164197 A 6/2003
JP 201496939 A 5/2014
JP 2017-229165 A 12/2017

* cited by examiner

*Primary Examiner* — Ryan D Walsh
(74) *Attorney, Agent, or Firm* — Venable LLP

(57) ABSTRACT

A control apparatus includes: a driving unit configured to drive a member into rotation; a detection unit configured to detect a torque exerted on the driving unit; and a control unit configured to control the driving unit and the member. The control unit is further configured to: when a state control of the member associated with a change of the torque exerted on the driving unit is performed, determine a change timing of the torque exerted on the driving unit and a value of the torque exerted on the driving unit at the change timing on a basis of a detection result of the detection unit; and determine a start timing of the state control of a case where the state control is again performed on the member on a basis of the change timing and the value of the torque.

22 Claims, 7 Drawing Sheets

CONTROL APPARATUS FOR DRIVING A MEMBER INTO ROTATION AND IMAGE FORMING APPARATUS

BACKGROUND OF THE INVENTION

Field of the Invention

The present invention relates to a control technique in which a member configured to be driven into rotation and a driving source configured to drive the member into rotation are provided and a state control associated with a change of a torque exerted on the driving source is performed on the member.

Description of the Related Art

As a driving source of an image forming apparatus, a DC brushless motor of a sensorless control system without mounting a rotor-position detection sensor is used. The sensorless control includes a motor control unit in the image forming apparatus estimating the rotor position on the basis of an induced voltage generated by the rotation of the rotor. However, during a period in which the rotation of the rotor is slow, the motor control unit of the image forming apparatus cannot detect the induced voltage. As such, when activating a motor in a stopped state, the motor control unit performs a forcible commutation. The forcible commutation is control of sequentially energizing coils of the motor in a predetermined energization pattern to thereby forcibly rotate the rotor. Note that the forcible commutation is an open-loop control. The motor control unit repeats the forcible commutation, and, when detection of an induced voltage is possible, the motor control unit performs a closed loop control by the rotor position estimated based on the induced voltage.

Some image forming apparatuses separate the developing roller from the photosensitive member while image formation is not performed. The object for this is to prevent plastic deformation of the photosensitive member and/or the developing roller, adhesion of toner, and the like. Further, for the purpose of reducing deterioration of the photosensitive member, the developing roller, and the toner, some image forming apparatuses separate the developing roller from the motor with a clutch and the like and stop the rotation of the developing roller while image formation is not performed. In these cases, to shorten the time required for image formation, it is necessary to quickly bring the developing roller into contact with the photosensitive member, and/or to quickly start the rotation of the developing roller, for example.

However, when the developing roller is brought into contact with the photosensitive member during the open loop control of the motor and/or immediately after switching the control of the motor from the open loop control to the closed loop control, a large torque can be exerted on the motor, and the rotation of the motor can become unstable. One of the causes of the unstable rotation of the motor is that an increase of the load of the motor reduces the rotational speed of the rotor and makes it difficult to detect the induced voltage. Another cause of the unstable rotation of the motor is that the system for estimating the rotor position oscillates when large fluctuations occur during estimation of the rotor position. In this way, increasing the load on the motor immediately after activation of the motor can cause the unstable rotation of the motor.

Japanese Patent Laid-Open No. 7-298678 discloses a configuration in which a voltage applied to a sensorless DC brushless motor is increased to prevent the motor from becoming unstable during activation.

However, the configuration disclosed in Japanese Patent Laid-Open No. 7-298678 requires an additional circuit configured for variable voltage application to the motor, and consequently the control configuration of the motor is complicated.

As described above, an image forming apparatus includes a member such as a developing roller that is driven by a motor, and in the image forming process, the image forming apparatus performs, on the member, a state control associated with a change of the torque exerted on the motor. To shorten the time required for image formation, it is important to start the state control at an early timing; however, the rotation of the motor can become unstable when the timing is too early. That is, it is necessary to appropriately set the timing at which to start the state control of the member.

SUMMARY OF THE INVENTION

According to an aspect of the present invention, a control apparatus includes: a member configured to be driven into rotation; a driving unit configured to drive the member into rotation; a detection unit configured to detect a torque exerted on the driving unit; and a control unit configured to control the driving unit and the member. The control unit is further configured to: when a state control of the member associated with a change of the torque exerted on the driving unit is performed, determine a change timing of the torque exerted on the driving unit and a value of the torque exerted on the driving unit at the change timing on a basis of a detection result of the detection unit; and determine a start timing of the state control of a case where the state control is again performed on the member on a basis of the change timing and the value of the torque.

Further features of the present invention will become apparent from the following description of exemplary embodiments with reference to the attached drawings.

DESCRIPTION OF THE EMBODIMENTS

Figure 1:
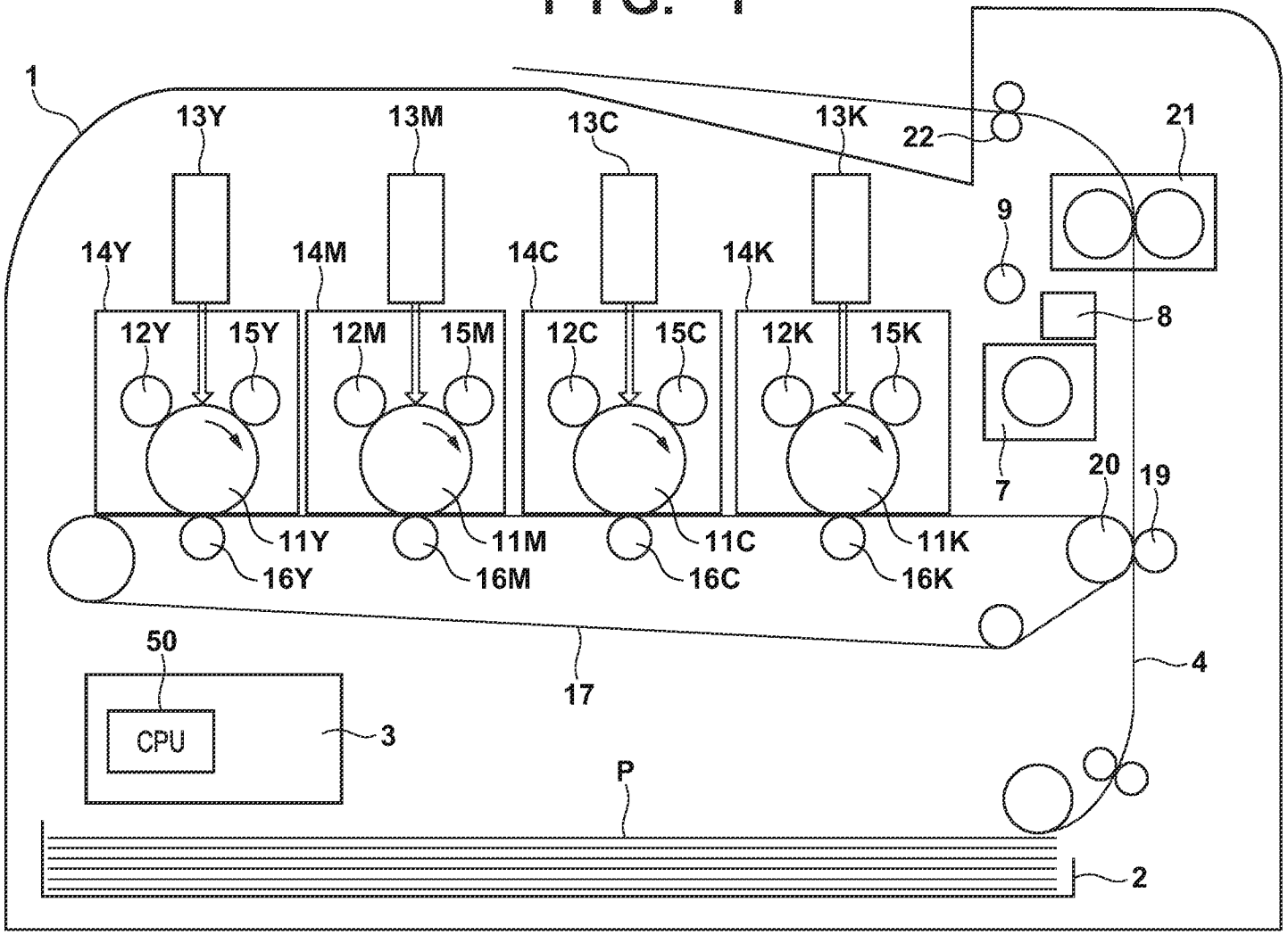
FIG. 1 is a configuration diagram of an image forming apparatus according to one embodiment.

Embodiments of the present invention are described below with reference to the accompanying drawings. Note that the following embodiments are merely examples, and the present invention is not limited to the embodiments. Further, components that are not necessary for the description of the embodiments are omitted in the drawings.

First Embodiment

FIG. 1 is a configuration diagram of an image forming apparatus 1 according to the present embodiment. The image forming apparatus 1 forms a full color image by forming toner images of four colors, yellow (Y), magenta (M), cyan (C), and black (K) in an overlapping manner. In FIG. 1, Y, M, C, and K at the ends of reference signs indicate colors, namely, yellow, magenta, cyan, and black, of toner images formed by the members indicated by the respective reference signs. Note that when the color is not required to be distinguished in the following description, Y, M, C and K are not attached to the reference symbol. A photosensitive member 11 (i.e., 11*y*, 11*m*, 11*c*, and 11*k*, for the respective colors) is driven into rotation in the clockwise direction in the drawing when forming the image. A charging unit 12 (i.e., 12*y*, 12*m*, 12*c*, 12*k*) charges the surface of the respective photosensitive member 11 to a uniform electric potential. An exposure unit 13 (i.e., 13*y*, 13*m*, 13*c*, 13*k*) forms an electrostatic latent image on the respective photosensitive member 11 by exposing the surface of the photosensitive member 11 to light. A developing roller 15 (i.e., 15*y*, 15*m*, 15*c*, 15*k*) of a developing unit develops the electrostatic latent image of the respective photosensitive member 11 with a toner to visualize the image as a toner image. With a primary transfer bias, a primary transfer unit 16 (i.e., 16*y*, 16*m*, 16*c*, 16*k*) transfers the toner image formed on the respective photosensitive member 11 to the intermediate transfer belt 17. Note that a full color image is formed on the intermediate transfer belt 17 by transferring the toner image formed on each photosensitive member 11 in an overlapping manner on the intermediate transfer belt 17.

The intermediate transfer belt 17 is driven by a driving roller 20 into rotation in the counterclockwise direction in the drawing. As a result, the toner image transferred to the intermediate transfer belt 17 is conveyed to an opposing position of a secondary transfer unit 19. A recording material P stored in a cassette 2 is conveyed along a conveyance path 4 to the opposing position of the secondary transfer unit 19. A roller for conveying the recording material P is provided on the transport path 4. With a secondary transfer bias, the secondary transfer unit 19 transfers the toner image of the intermediate transfer belt 17 to the recording material P. Thereafter, the recording material P is conveyed to a fixing unit 21. The fixing unit 21 applies heat and pressure to the recording material P to fix the toner image to the recording material P. After the toner image is fixed, the recording material P is discharged by a discharge roller 22 to the outside of the image forming apparatus.

In the present embodiment, a motor 7 transmits its driving force to the photosensitive member 11, the charging unit 12, the developing roller 15, the primary transfer unit 16, and the driving roller 20 via a gear mechanism (not illustrated). In addition, a solenoid 8 brings the developing roller 15 into contact with the photosensitive member 11 and separates the developing roller 15 and the photosensitive member 11 via a gear mechanism not illustrated. Specifically, when the solenoid 8 is in the OFF state, the developing roller 15 is separated from the photosensitive member 11. When the solenoid 8 is in the ON state, the developing roller 15 is brought into contact with the photosensitive member 11. Further, a clutch 9 can transmit the driving force of the motor 7 to the developing roller 15, and can block the transmission of the driving force of the motor 7 to the developing roller 15. A cartridge 14 (i.e., 14*y*, 14*m*, 14*c*, 14*k*) includes the respective photosensitive member 11, the respective charging unit 12, and the respective developing roller 15, and is configured to be detachable from the image forming apparatus 1. A control unit 3 including a CPU 50 controls the entire image forming apparatus. Note that the control unit 3 performs a state control of the developing roller 15. The state control of the developing roller 15 includes, for example, control of bringing the developing roller 15 into contact with the photosensitive member 11, and control of separating the developing roller 15 from the photosensitive member 11. Further, the state control of the developing roller 15 includes, for example, control of transmitting the driving force of the motor 7 to the developing roller 15, and control of blocking the transmission of the driving force of the motor 7 to the developing roller 15.

Figure 2:
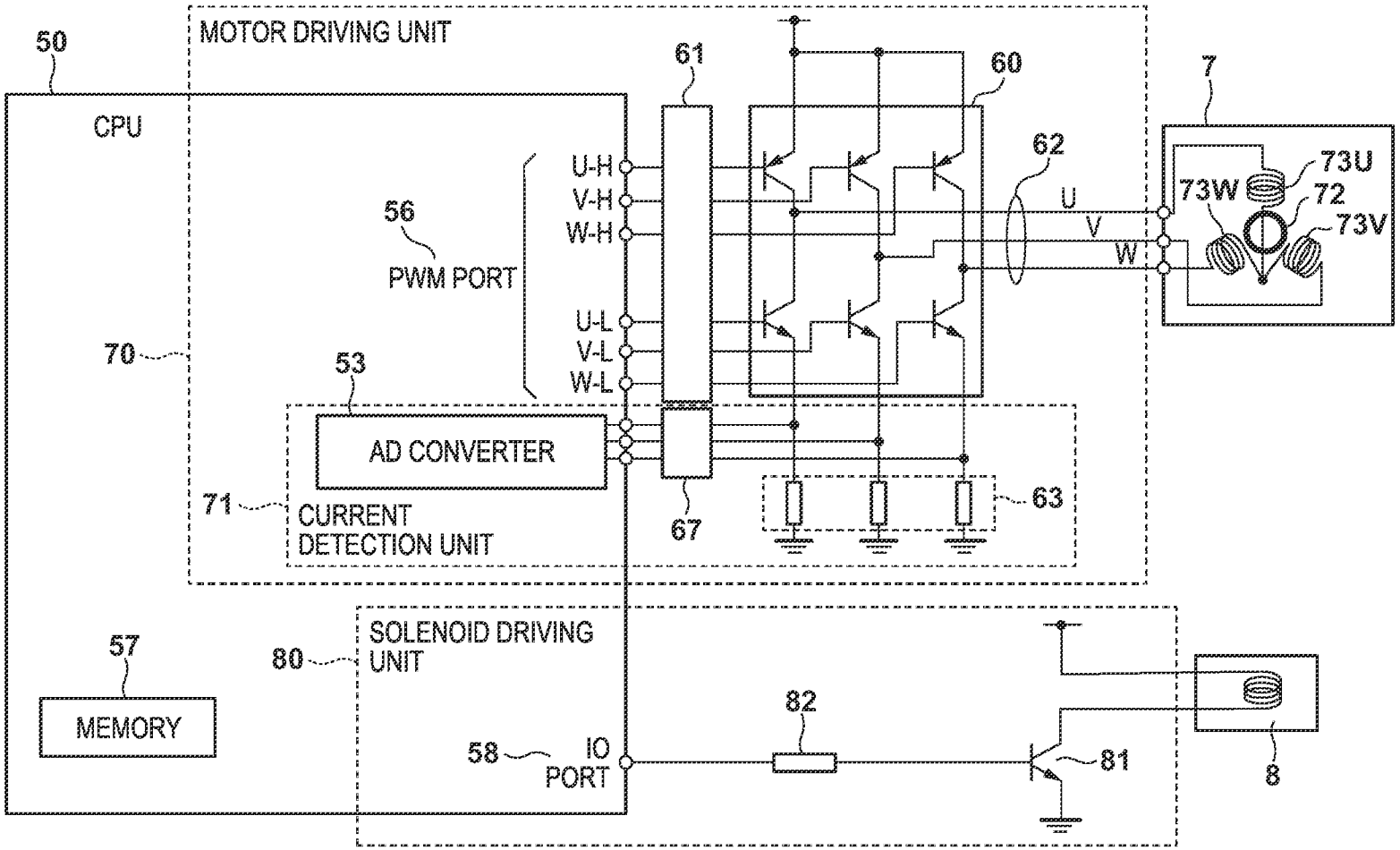
FIG. 2 is a diagram illustrating a control configuration of a motor and a solenoid according to one embodiment.

FIG. 2 illustrates a control configuration of the motor 7 and the solenoid 8. The motor 7 is a sensorless motor without a sensor for detecting the rotor position, and a motor driving unit 70 sensorless-drives the motor 7. Note that the motor 7 includes a rotor 72, which is a rotator, and coils 73U, 73V and 73W of respective phases wound on the stator. The motor driving unit 70 is composed of the CPU 50, a gate driver 61, an inverter 60, a resistor 63, and an inverting amplifier 67. Note that a memory 57 of the CPU 50 is used to store temporary data and the like in various controls executed by the CPU 50. A PWM port 56 of the CPU 50 of the motor driving unit 70 outputs PWM signals. In the present embodiment, for the three phases (U, V, W) of the motor 7, the CPU 50 outputs six PWM signals including high PWM signals (U-H, V-H and W-H) and low PWM signals (U-L, V-L and W-L). As such, the PWM port 56 includes six terminals, U-H, V-H, W-H, U-L, V-L and W-L.

Each terminal of the PWM port 56 is connected to the gate driver 61, and the gate driver 61 performs ON/OFF control of each switching element of the three-phase inverter 60 on the basis of the PWM signal. Note that the inverter 60 includes six switching elements, namely, three switching elements on the high side and three switching elements on the low side, and the gate driver 61 controls each switching element on the basis of the corresponding PWM signal. For example, a transistor or an FET may be used as the switching element. In the present embodiment, when the PWM signal is high, the corresponding switching element is set to ON, and when the signal is low, the corresponding switching element is set to OFF. An output 62 of the inverter 60 is connected to the coil 73U of the U phase, the coil 73V of the V phase, and the coil 73W of the W phase of the motor 7. By controlling ON/OFF of each switching element of the inverter 60, the excitation current (coil current) of each of the coils 73U, 73V and 73W can be controlled. In the following description, the coils 73U, 73V and 73W are collectively referred to as coils 73.

A current detection unit 71 detects the coil current flowing in each coil 73. Specifically, the resistor 63 converts the coil current of each phase into a voltage, and the inverting amplifier 67 amplifies this voltage. Then, an AD converter 53 of the CPU 50 converts the voltage output by the inverting amplifier 67 to a digital value. The CPU 50 detects the coil current of each phase on the basis of the digital value output by the AD converter 53.

The CPU 50 estimates and calculates the torque exerted on the motor 7 on the basis of the coil current of each phase. The method of estimating the torque based on the coil current of each phase of the three-phase brushless motor is known as disclosed in Japanese Patent Laid-Open No. 2003-164197, and therefore the description thereof is omitted here. In addition, the motor 7 of the present embodiment is of a sensorless type and does not include a sensor for detecting the position (rotation angle) of the rotor 72. As such, the CPU 50 estimates the position of the rotor 72 on the basis of the coil current detected by the current detection unit 71. The method of estimating the position of the rotor 72 on the basis of the coil current is known as disclosed in Japanese Patent Laid-Open No. 2003-164197, and therefore the description thereof is omitted.

A solenoid driving unit 80 drives the solenoid 8. The solenoid driving unit 80 includes the CPU 50, a resistor 82, and a switching element 81 such as a transistor or an FET. An IO port 58 of the CPU 50 of the solenoid driving unit 80 outputs a solenoid driving signal for turning ON/OFF the switching elements. In the present embodiment, when the solenoid driving signal is high, the switching element 81 is set to ON, and when the solenoid driving signal is low, the switching element is set to OFF. When the switching element 81 is set to ON, a current flows through the solenoid 8, and the solenoid 8 is set to the ON state, thus suction of a flapper is performed (not illustrated). When the switching element 81 is set to OFF, the solenoid 8 is set to the OFF state.

Figure 3:
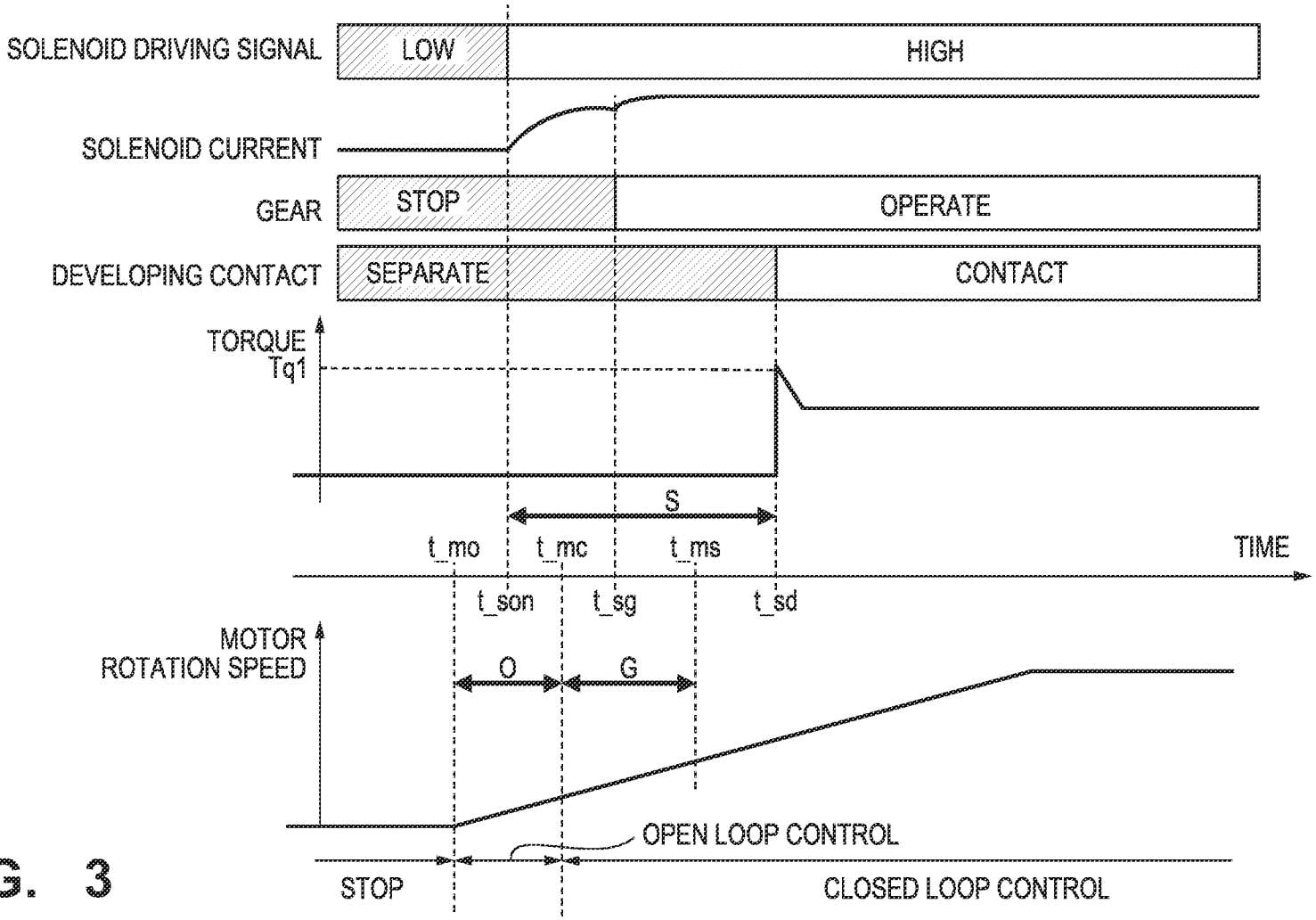
FIG. 3 is an explanatory diagram illustrating timings of control of the motor and the solenoid according to one embodiment.

FIG. 3 is an explanatory diagram of a control process of the motor 7 and the solenoid 8 at a start of image formation by the control unit 3. After the image formation is started, the control unit 3 starts a forcible commutation of the motor 7 at a predetermined control timing t_mo so as to rotate the rotor 72 from a stopped state. The period of the forcible commutation corresponds to the open-loop control. After the start of the forcible commutation, the control unit 3 switches the motor 7 to the sensorless control at a timing t_mc at which the open loop control period O has elapsed. The sensorless control is the closed loop control by vector control, for example. Note that the open loop control period O is set in advance in the memory 57 of the CPU 50 such that, at the elapse of the period, the rotational speed of the rotor 72 can be detected from the induced voltage generated in each coil 73. After switching to the sensorless control, the control unit 3 further accelerates the rotor 72 so as to rotate the rotor 72 at a target speed.

At the start of an image formation, the solenoid driving signal is low, and accordingly the solenoid 8 is in the OFF state. That is, the developing roller 15 is separated from the photosensitive member 11. At a predetermined start timing t_son, the control unit 3 sets the solenoid driving signal output from the IO port 58 to high to set the solenoid 8 to the ON state. As a result, the flapper of the solenoid 8 is sucked at a timing t_sg, and the gear starts moving. Then, at a timing t_sd, the developing roller 15 is brought into contact with the photosensitive member 11. At this contact timing t_sd, the torque exerted on the motor 7 increases. Hereinafter, the torque at the time when the developing roller 15 is brought into contact with the photosensitive member 11 is referred to as "contact torque Tq1". The electrostatic latent image of the photosensitive member 11 is not developed until the developing roller 15 is brought into contact with the photosensitive member 11. Accordingly, when the time taken to bring the developing roller 15 into contact with the photosensitive member 11 increases, the time required for image formation also increases.

On the other hand, when a large torque is exerted on the motor 7 immediately after switching the control of the motor 7 from the open loop control to the closed loop control, the rotation of the motor 7 tends to become unstable. As such, a predetermined guard period G needs to be ensured between the switching of the motor 7 to the closed loop control and the contact of the photosensitive member 11 and the developing roller 15. In other words, when the guard end timing t_ms is set to a timing later by the guard period G than the timing t_mc of switching to the closed loop control, the contact timing t_sd of the photosensitive member 11 and the developing roller 15 needs to be the guard end timing t_ms or later. Note that the guard period G needs to be increased as the contact torque Tq1 increases.

However, a contact period (delay period) S, which is a period until the developing roller 15 is brought into contact with the photosensitive member 11 after the solenoid driving signal is set to high, differs among image forming apparatuses. The reason for this is the variation in the response time among solenoids 8, and the variation in the dimensional precision in assembly and components of the image forming apparatus 1 and/or the cartridge 14. For example, the variation in the contact period S among image forming apparatuses is several tens of msec.

Figure 4:
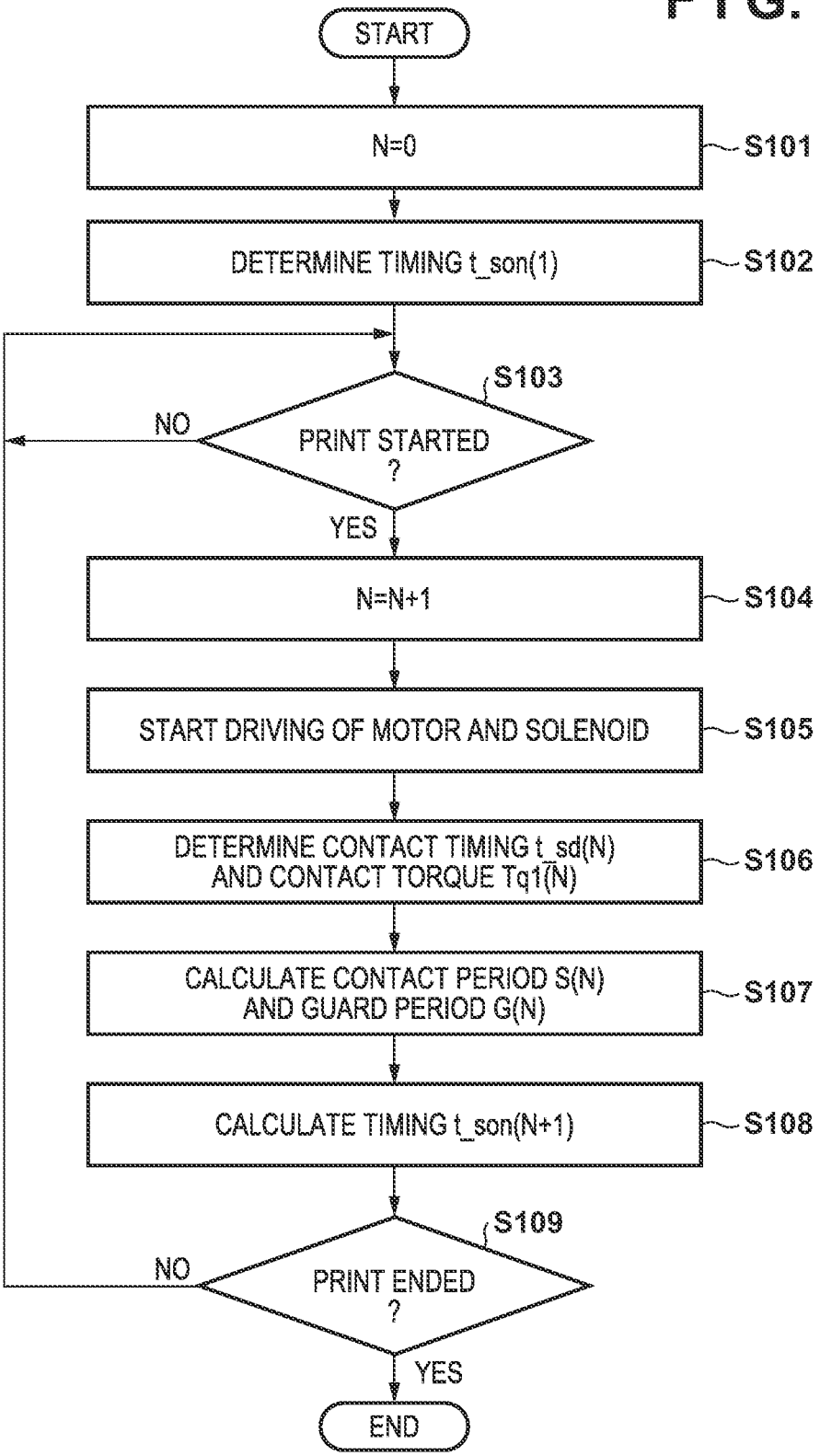
FIG. 4 is a flowchart of an image forming process according to one embodiment.

FIG. 4 is a flowchart of an image formation process according to the present embodiment. Note that FIG. 4 illustrates a flowchart of the case where the image forming apparatus 1 performs an image forming process for the first time, and the case where the image forming apparatus 1 performs an image formation process for the first time after replacement of the cartridge 14. At S101, the control unit 3 initializes, to zero, the integer N indicating the number of recording materials P having been used for the image formation. At S102, on the basis of the predetermined guard period G(0) and contact period S(0), the control unit 3 determines a start timing t_son(1) at which to set the solenoid driving signal to high in accordance with the following Equation (1).

$$t_son(N+1)=t_mo+O+G(N)-S(N)+M1 \quad (1)$$

Note that G(N) and S(N) are the guard period G and the contact period S at the time when the image formation is performed on an Nth recording material. In addition, t_son (N) is the start timing t_son for performing image formation on an Nth recording material. Further, M1, which is a predetermined margin, may be set to a value of 0 or greater. For example, it is assumed that the contact period and the guard period in the image formation on an N+1th recording material are equal to S(N) and G(N), respectively, and the solenoid driving signal is set to high at the start timing t_son(N+1) determined in accordance with the Equation (1). In this case, when the period M1 elapses after the guard period G has ended, the developing roller 15 is brought into contact with the photosensitive member 11. Here, G(0), which is an initial value, is set based on the value required when the contact torque Tq1 has the maximum value assumed in the image forming apparatus 1. Note that a value greater than the guard period required for the maximum value of the contact torque Tq1 may be set as G(0) in consideration of a margin for G(0). In addition, S(0), which is an initial value, sets an assumed shortest time. Specifically, S(0) is a shortest time taking into consideration the variations in the time until the developing roller 15 is brought into contact with the photosensitive member 11 after the gear is rotated and/or the shortest value of the response time of the solenoid 8. Alternatively, S(0) may be 0 second so as to maximize the margin.

When the control unit 3 determines the start timing t_son(1) at S102, the control unit 3 waits at S103 until printing is started. When printing is started, the control unit 3 increases N by 1 at S104. The control unit 3 controls the motor 7 and the solenoid 8 at S105. Specifically, as illustrated in FIG. 3, the open loop control of the motor 7 is started at the timing t_mo, and the control of the motor 7 is switched to the closed loop control at the timing t_mc, which is a timing later than the timing t_mo by the open loop control period O. Further, the solenoid driving signal is set to high at the start timing t_son(N).

At S106, the control unit 3 monitors the value of the current flowing in the coil 73 by the current detection unit 71, and thus detects the contact timing t_sd(N) at which the developing roller 15 is brought into contact with the photosensitive member 11. As described above, when the developing roller 15 is brought into contact with the photosensitive member 11, the torque exerted on the motor 7 increases, and the current flowing in the coil 73 also increases. Accordingly, by detecting the change timing at which the current flowing in the coil 73 temporarily increases, the control unit 3 can detect the contact timing t_sd(N). Further, the control unit 3 calculates the value (torque value) of the contact torque Tq1(N) on the basis of the current value of the coil 73 at the contact timing t_sd(N). On the basis of the contact timing t_sd(N), the control unit 3 determines the contact period S(N) in accordance with the following Equation (2) at S107.

$$S(N)=t_sd(N)-t_son(N) \quad (2)$$

In addition, on the basis of the contact torque Tq1(N), the control unit 3 determines the guard period G(N) at S107. Note that, as described above, the guard period G is dependent on the contact torque Tq1, and the relationship between the guard period G and the contact torque Tq1 is set in advance in the control unit 3. At S108, the control unit 3 determines the start timing t_son(N+1) from S(N) and G(N) in accordance with the Equation (1). At S109, the control unit 3 determines whether the image formation on all recording materials has been completed. When the image formation on all the recording materials has not been completed, the control unit 3 repeats the processes from S103. When the image formation on all the recording materials has been completed, the control unit 3 terminates the processes of FIG. 4. Note that the control unit 3 stores the start timing t_son determined at S108 of the last image formation. Then, when the next print job is started, the control unit 3 sets the solenoid driving signal to high at the stored start timing t_son in the first image formation of the print job.

In a conventional configuration, a sufficiently long time is ensured as the guard period Gin consideration of the fluctuations of the contact torque Tq1 when the developing roller 15 is brought into contact with the photosensitive member 11. In addition, the contact period S is set to a shortest possible period in consideration of the variation in each solenoid 8. In other words, the start timing t_son of the operation of the solenoid 8 is set to an assumed latest possible period so as to make sure that the contact timing between the developing roller 15 and the photosensitive member 11 is set at a timing after the elapse of the guard period G. On the other hand, in the present embodiment, the guard period G and the contact period S are determined for each image formation on the basis of the contact torque Tq1 and the contact timing t_sd measured at the image forming on the recording material. Then, on the basis of the determined guard period G and the contact period S, the start timing t_son at which to start control of the solenoid 8 is dynamically determined in the next image formation. For example, the larger the contact torque Tq1, the greater the guard period G In view of this, with respect to the control timing t_mo of the motor 7, the larger the contact torque Tq1, the later the start timing t_son to be set. With this configuration, the start timing t_son can be set to an appropriate timing in accordance with the state of the image forming apparatus, and the time required for the image formation can be shortened.

Note that the time period between the timing t_sg, at which the gear starts moving, and the contact timing t_sd varies depending on the rotational speed of the motor 7 rotating the gear. However, the influence of such a variation is small and therefore can be ignored. Note that, when this influence is taken strictly into consideration, the contact period S may be acquired from two periods, a period before the timing t_sg and a period after the timing t_sg. The rotation angle θc of the motor between the start of the rotation of the gear and when the developing roller 15 is brought into contact with the photosensitive member 11 is known and can be determined by integrating the rotation speed ω(t) of the motor 7 from the timing t_sg to t_sd. Accordingly, the timing t_sg can be determined from the time-series information of the rotation speed w(t) and the rotation angle θc.

Note that in the present embodiment, the change timing of the contact torque Tq1 and the torque value at that time are estimated and calculated on the basis of the detection result of the current of the coil 73 by the current detection unit 71. However, it is possible to adopt a configuration of using a torque sensor that directly detects the torque value of the contact torque Tq1. In addition, in the present embodiment, the current detection unit 71 that detects the current of the coil 73 is composed of the resistor 63, the inverting amplifier 67, and the AD converter 53. Alternatively, it is also possible to adopt a configuration of using a current sensor that directly detects the current flowing in the coil 73. In addition, in the present embodiment, the start timing t_son of the operation of the solenoid 8 is a relative timing with respect to the control timing t_mo of the motor 7, and the control timing of the motor 7 is set to the timing of starting the forcible commutation of the motor 7. Alternatively, the control timing may be set to the timing t_mc of switching from the forcible commutation to the closed loop control, and the start timing t_son of the operation of the solenoid 8 may be set with respect to this control timing.

Second Embodiment

Figure 5:
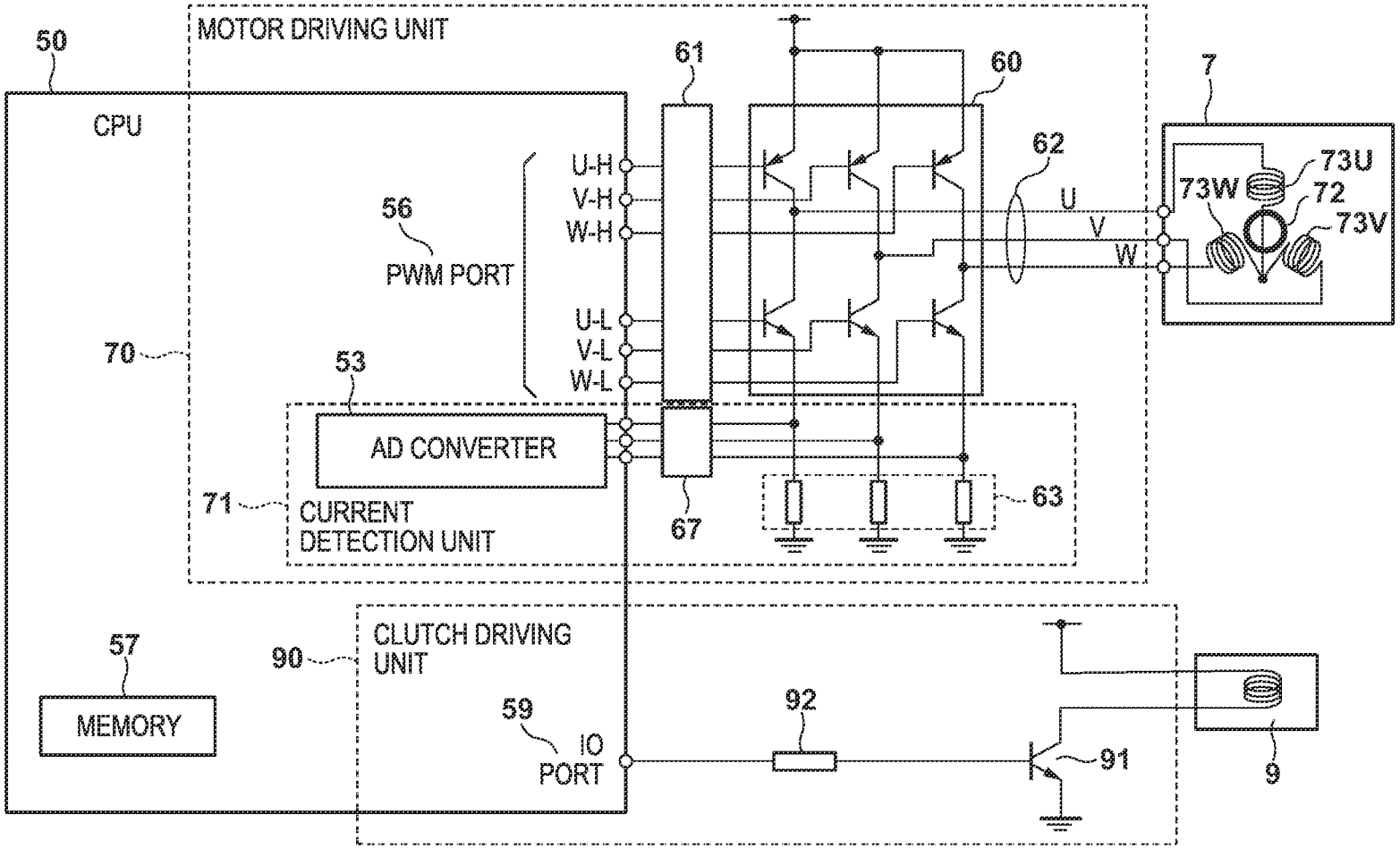
FIG. 5 is a diagram illustrating a control configuration of a motor and a clutch according to one embodiment.

The following describes Second Embodiment, mainly about differences from First Embodiment. FIG. 5 illustrates a control configuration of the motor 7 and the clutch 9 according to the present embodiment. Note that the control configuration of the solenoid 8 is omitted in FIG. 5. The same reference numerals are given to configurations similar to those of the control configuration of First Embodiment illustrated in FIG. 2, and description thereof is omitted. A clutch driving unit 90 drives the clutch 9. The clutch driving unit 90 is composed of the CPU 50, a resistor 92, and a switching element 91 such as a transistor and an FET. An IO port 59 of the CPU 50 of the clutch driving unit 90 outputs a clutch driving signal for turning ON/OFF the switching element 91. In the present embodiment, when the clutch driving signal is high, the switching element 91 is set to ON, and when the clutch driving signal is low, the switching element 91 is set to OFF. When the switching element 91 is turned ON, a current flows through the clutch 9, and the clutch 9 is set to the ON state, and thus, the motor 7 drives the developing roller 15 into rotation. When the switching element 91 is turned OFF, the clutch 9 is set to the OFF state, and the driving force of the motor 7 is not transferred to the developing roller 15.

Figure 6:
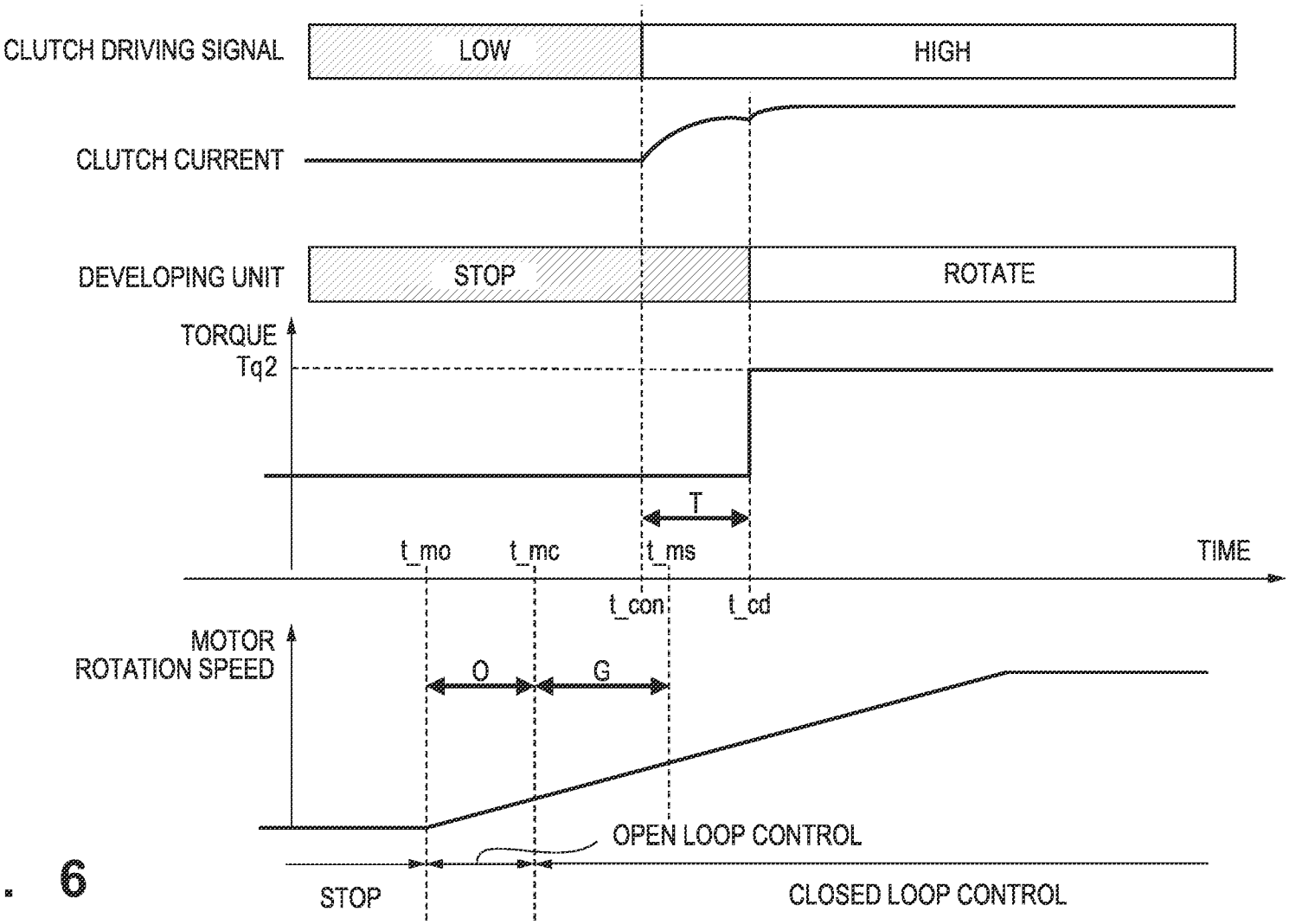
FIG. 6 is an explanatory diagram of timings of control of the motor and the clutch according to one embodiment.

FIG. 6 is an explanatory diagram of a control process of the motor 7 and the clutch 9 at the start of an image formation by the control unit 3. Note that the developing roller 15 and the photosensitive member 11 are separated from each other. First, the control of the motor 7 is the same as that of First Embodiment, and therefore the description thereof is omitted. The control unit 3 sets the clutch driving signal output from the IO port 59 to high at a predetermined start timing t_con, and sets the clutch 9 to the ON state. As a result, a rotation of the developing roller 15 is started at a rotation timing t_cd. At this rotation timing t_cd, the torque exerted on the motor 7 increases. The torque exerted on the motor 7 at the rotation timing t_cd of the developing roller 15 is referred to as a rotational torque Tq2. Note that it is assumed that the backlash of the gear from the clutch 9 to the developing roller 15 is small and the time thereof can be ignored. Further, after rotating the developing roller 15, the solenoid 8 is driven to bring the developing roller 15 and the photosensitive member 11 into contact with each other. By controlling the transmission and blocking of the driving force to the developing roller 15 with the clutch 9, the period of the rotation of the developing roller 15 can be shortened, and thus deterioration of the developing roller 15 and the toner can be reduced. In addition, by driving the clutch 9 to rotate the developing roller 15 before the developing roller 15 is brought into contact with the photosensitive member 11, the impact and/or torque fluctuations when the rotating photosensitive member 11 is brought into contact with the developing roller 15 can be reduced.

As in First Embodiment, the rotation timing t_cd needs to be set at a time later than the elapse of the guard period G Here, the transmission period (delay period) T, which is a period between the setting the clutch driving signal to high and the start of a rotation of the developing roller 15, varies among image forming apparatuses due to a variation in the response time of clutches 9 and the like. The variation in the transmission period T is several msec to several tens of msec.

Figure 7:
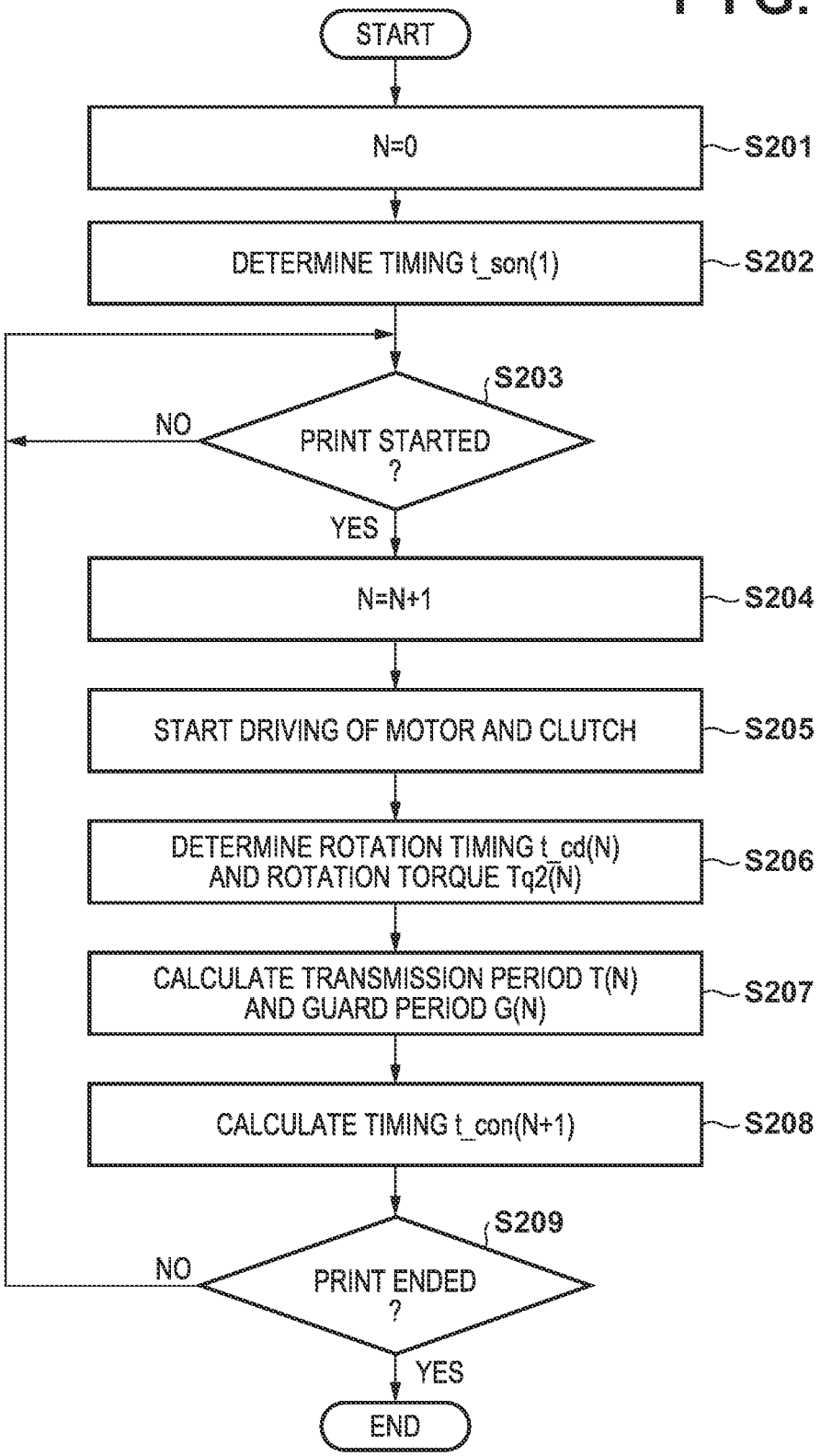
FIG. 7 is a flowchart of an image forming process according to one embodiment.

FIG. 7 is a flowchart of an image formation process according to the present embodiment. Note that FIG. 7 illustrates a flowchart of the case where the image forming apparatus 1 performs an image forming process for the first time, and the case where the image forming apparatus 1 performs an image formation process for the first time after replacement of the cartridge 14. At S201, the control unit 3 initializes, to zero, the integer N indicating the number of recording materials P having been used for the image formation. At S202, on the basis of the predetermined guard period G(0) and transmission period T(0), the control unit 3 determines a start timing t_con(1) at which to set the clutch driving signal to high in accordance with the following Equation (3).

$$t_con(N+1)=t_mo+G(N)-T(N)+M2 \quad (3)$$

Note that G(N) and T(N) are the guard period G and the transmission period T, respectively, in the image formation performed on the Nth recording material. In addition, t_con (N) is the start timing t_con in the image formation on the Nth recording material. Further, M2, which is a predetermined margin, may be set to a value of 0 or greater. When the clutch driving signal is set to high at the start timing t_con (N+1) determined by the above-described Equation (3) when the transmission period is T(N) and the guard period is G(N), the rotation of the developing roller 15 starts when the period M2 elapses after the guard period has ended. Note that G(0), which is an initial value, is set as the value required when the rotational torque Tq2 is the maximum value assumed in the image forming apparatus 1. Note that a value greater than the value required for the maximum value assumed in the image forming apparatus 1 may be set as G(0) in consideration of a margin for G(0). In addition, T(0), which is an initial value, sets an assumed shortest time taking into consideration the variation in the response time of the clutch 9. Alternatively, T(0) may be 0 second so as to maximize the margin.

When the control unit 3 determines the start timing t_con(1) at S202, the control unit 3 waits at S203 until the print is started. When printing is started, the control unit 3 increases N by 1 at S204. The control unit 3 controls the motor 7 and the clutch 9 at S205. Specifically, as illustrated in FIG. 6, the open loop control of the motor 7 is started at the control timing t_mo, and the control of the motor 7 is switched to the closed loop control at the timing t_mc at which the open loop control period O has elapsed from the control timing t_mo. Also, at the start timing t_con(N), the clutch driving signal is set to high.

At S206, the control unit 3 monitors the value of the current flowing in the coil 73 by the current detection unit 71, and thus detects the rotation timing t_cd(N) of the developing roller 15. As described above, when the developing roller 15 starts rotating, the torque exerted on the motor 7 increases, and the current flowing in the coil 73 also increases. Accordingly, by detecting the timing at which the current flowing in the coil 73 temporarily increases, the control unit 3 can detect the rotation timing t_cd(N). Further, the control unit 3 calculates a rotational torque Tq2(N) on the basis of the current value of the coil 73 at the rotation timing t_cd(N). On the basis of the rotation timing t_cd(N), the control unit 3 determines the transmission period T(N) in accordance with the following Equation (4) at S207.

$$T(N)=t_cd(N)-t_con(N) \quad (4)$$

In addition, the control unit 3 determines the guard period G(N) on the basis of the rotational torque Tq2(N) at S207. Note that the relationship between the guard period G and the rotational torque Tq2 is set in advance in the control unit 3 as in First Embodiment. At S208, the control unit 3 determines the start timing t_con (N+1) from T(N) and G(N) in accordance with the Equation (3). At S209, the control unit 3 determines whether the image formation on all the recording materials has been completed. When the image formation on all the recording materials has not been completed, the processes are repeated from S203. When the image formation on all the recording materials has been completed, the control unit 3 terminates the processes of FIG. 7. Note that the control unit 3 stores the start timing t_con determined at S208 of the last image formation. Then, when the next print job is started, control unit 3 sets the clutch driving signal to high at the stored start timing t_con in the first image formation of the print job.

Note that the above-described embodiments have been described based on the color image forming apparatus. However, the present invention may be applied to a monochrome image forming apparatus. The present invention may also be applied to apparatuses other than image forming apparatuses. Specifically, the present invention may be applied to any control apparatus including a member that is driven into rotation, a driving unit that drives the member into rotation, and a control unit that performs, on the member, a state control associated with a change and a variation of a torque exerted on the driving unit.

Other Embodiments

Embodiments of the present invention can also be realized by a computer of a system or apparatus that reads out and executes computer executable instructions (e.g., one or more programs) recorded on a storage medium (which may also be referred to more fully as 'non-transitory computer-readable storage medium') to perform the functions of one or more of the above-described embodiments and/or that includes one or more circuits (e.g., application specific integrated circuit (ASIC)) for performing the functions of one or more of the above-described embodiments, and by a method performed by the computer of the system or apparatus by, for example, reading out and executing the computer executable instructions from the storage medium to perform the functions of one or more of the above-described embodiments and/or controlling the one or more circuits to perform the functions of one or more of the above-described embodiments. The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-139622, filed on Jul. 25, 2018, which is hereby incorporated by reference herein in its entirety.

What is claimed is:

1. A control apparatus comprising:

a member configured to be driven into rotation;

a driving unit configured to drive the member into rotation;

a detection unit configured to detect a torque exerted on the driving unit; and a control unit configured to control the driving unit and the member, wherein the control unit is further configured to: when a state control of the member associated with a change of the torque exerted on the driving unit is performed, determine a change timing of the torque exerted on the driving unit and a value of the torque exerted on the driving unit at the change timing on a basis of a detection result of the detection unit; and determine a start timing of the state control of a case where the state control is again performed on the member on a basis of the change timing and the value of the torque.

2. The control apparatus according to claim 1, wherein the start timing is a relative timing with respect to a control timing of the driving unit by the control unit.

3. The control apparatus according to claim 2, wherein the driving unit is a motor; and the control timing is a timing at which the control unit starts rotation of the motor.

4. The control apparatus according to claim 2, wherein the driving unit is a sensorless motor; and the control timing is a timing at which the control unit starts an open loop control of the sensorless motor.

5. The control apparatus according to claim 2, wherein the driving unit is a sensorless motor; and the control timing is a timing at which the control unit starts a closed loop control of the sensorless motor.

6. The control apparatus according to claim 5, wherein the control timing is a timing at which the control unit switches control of the sensorless motor from an open loop control to the closed loop control.

7. The control apparatus according to claim 2, wherein the control unit is further configured to:

determine a guard period of the driving unit on a basis of the value of the torque;

determine a guard end timing on a basis of the guard period and the control timing of the driving unit; and determine the start timing such that the change timing of the torque exerted on the driving unit in the state control performed on the member is the same as the guard end timing or is later than the guard end timing.

8. The control apparatus according to claim 7, wherein the guard end timing is a timing later than the control timing of the driving unit by at least the guard period.

9. The control apparatus according to claim 7, wherein when the state control is performed on the member, the control unit determines a delay period between a timing of a start of the state control and the change timing of the torque exerted on the driving unit, and determines the start timing on a basis of the guard end timing and the delay period.

10. The control apparatus according to claim 9, wherein the start timing determined by the control unit is a timing earlier than the guard end timing by the delay period or a timing later than the timing earlier than the guard end timing by the delay period.

11. The control apparatus according to claim 1, wherein the member is a member used in an image forming process of forming an image on a recording material.

12. A control apparatus comprising:

a member configured to be driven into rotation;

a driving unit configured to drive the member into rotation; and a control unit configured to control the driving unit and the member, wherein the control unit further configured to:

when a value of a torque exerted on the driving unit is a first torque, set a start timing of a state control of the member associated with a change of the torque exerted on the driving unit to a first timing; and when the value of the torque exerted on the driving unit is a second torque that is greater than the first torque, set the start timing of the state control of the member to a second timing being later than the first timing.

13. An image forming apparatus comprising:

a photosensitive member on which an electrostatic latent image is formed;

a developing roller configured to develop the electrostatic latent image;

a driving unit configured to drive the developing roller into rotation;

a detection unit configured to detect a torque exerted on the driving unit; and a control unit configured to control the driving unit and the developing roller, wherein the control unit is further configured to: when a state control of the developing roller associated with a change of the torque exerted on the driving unit is performed, determine a change timing of the torque exerted on the driving unit and a value of the torque exerted on the driving unit at the change timing on a basis of a detection result of the detection unit; and determine a start timing of the state control of a case where the state control is again performed on the developing roller on a basis of the change timing and the value of the torque.

14. The image forming apparatus according to claim 13, wherein the state control is control of bringing the developing roller separated from the photosensitive member into contact with the photosensitive member.

15. The image forming apparatus according to claim 14, wherein the change of the torque exerted on the driving unit is caused when the developing roller is brought into contact with the photosensitive member.

16. The image forming apparatus according to claim 13, further comprising a contact unit configured to bring the developing roller into contact with the photosensitive member under control of the control unit, wherein the start timing is a timing at which the control unit starts control of the contact unit so as to bring the developing roller into contact with the photosensitive member.

17. The image forming apparatus according to claim 16, wherein the contact unit includes a solenoid; and the start timing is a timing at which the control unit feeds a current through the solenoid.

18. The image forming apparatus according to claim 13, wherein the state control is control of transmitting, to the developing roller, a driving force of the driving unit whose transmission to the developing roller is being blocked.

19. The image forming apparatus according to claim 18, further comprising a transmission unit configured to transmit a driving force of the driving unit to the developing roller and to block the driving force of the driving unit to the developing roller under control of the control unit, wherein the start timing is a timing at which the control unit starts control of the transmission unit blocking the transmission of the driving force of the driving unit to the developing roller so as to transmit the driving force of the driving unit to the developing roller.

20. The image forming apparatus according to claim 19, wherein the transmission unit includes a clutch configured to be controlled by a current; and the start timing is a timing at which the control unit feeds a current through the clutch.

21. The image forming apparatus according to claim 18, wherein the change of the torque exerted on the driving unit is caused when the driving force of the driving unit is transmitted to the developing roller.

22. An image forming apparatus comprising:

a photosensitive member on which an electrostatic latent image is formed;

a developing roller configured to develop the electrostatic latent image;

a driving unit configured to drive the developing roller into rotation; and a control unit configured to control the driving unit and the developing roller, wherein the control unit is further configured to:

when a value of a torque exerted on the driving unit is a first torque, set a start timing of a state control of the developing roller associated with a change of the torque exerted on the driving unit to a first timing; and when the value of the torque exerted on the driving unit is a second torque that is greater than the first torque, set the start timing of the state control of the developing roller to a second timing being later than the first timing.

* * * * *